United States Patent [19]

D'Eath

[11] Patent Number: 5,046,740

[45] Date of Patent: Sep. 10, 1991

[54] GOLF PUTTER

[76] Inventor: Roger A. D'Eath, 954 Country Club Dr., St. Clair Shores, Mich. 48042

[21] Appl. No.: 371,456

[22] Filed: Jun. 26, 1989

[51] Int. Cl.[5] ..... A63B 53/04; A63B 53/08

[52] U.S. Cl. ..... 273/164; 273/170; 273/171

[58] Field of Search ..... 273/167-175, 273/77 R, 77 A, 164 A, 164

[56] References Cited

U.S. PATENT DOCUMENTS

| | | | |
|---|---|---|---|
| D. 182,485 | 9/1957 | Sprinkel | D21/219 |
| D. 196,736 | 12/1962 | DeCarlo | D21/217 |
| 690,940 | 1/1902 | Febiger | 273/170 |
| 1,537,320 | 5/1925 | Marsh | 273/80.2 |
| 2,750,194 | 6/1956 | Clark | 273/171 |
| 2,957,696 | 9/1957 | Warpotas | 273/167 |
| 3,758,115 | 9/1973 | Hoglund | 273/164 |
| 3,888,484 | 6/1975 | Zitko | 273/80 C |
| 4,008,896 | 2/1977 | Gordos | 273/171 |
| 4,138,117 | 2/1979 | Dalton | 273/164 |
| 4,222,566 | 9/1980 | Berry | 273/164 |
| 4,253,667 | 3/1981 | Clark et al. | 273/168 |
| 4,688,798 | 8/1987 | Pelz | 273/164 |
| 4,714,252 | 12/1987 | Roraback | 273/171 |
| 4,754,976 | 7/1988 | Pelz | 273/169 |

FOREIGN PATENT DOCUMENTS

| | | | |
|---|---|---|---|
| 2337985 | 2/1975 | Fed. Rep. of Germany | 273/170 |
| 2930 | of 1898 | United Kingdom | 273/80 C |
| 242756 | 11/1925 | United Kingdom | 273/169 |
| 727051 | 3/1955 | United Kingdom | 273/169 |

*Primary Examiner*—Edward M. Coven
*Assistant Examiner*—Sebastiano Passaniti
*Attorney, Agent, or Firm*—Ralph M. Burton

[57] ABSTRACT

A substantially T-shaped putter type golf club including a shaft and a generally flat striking face disposed perpendicularly to a longitudinally body portion within which extends a bore that houses a plurality of weighted balls arranged in diametrically abutting relation such that a transfer of kinetic energy from the weighted balls to a golf ball upon impact drives the golf ball in the same direction as the alignment of the weighted balls.

9 Claims, 1 Drawing Sheet

GOLF PUTTER

FIELD OF INVENTION

This invention relates to golf putters.

BACKGROUND OF THE INVENTION

It has long been an object of those interested in perfecting the game of golf to devise a golf putter which will enable the player to be more accurate and consistent in putting. Several patents have issued endeavoring to provide designs to accomplish this objective, some of which are as follows: U.S. Design Pat. No. D182,485; U.S. Design Pat. No. D196,736; U.S. Pat. No. 2,957,696; U.S. Pat. No. 3,758,115; U.S. Pat. No. 3,888,484; U.S. Pat. No. 4,688,798; U.S. Pat. No. 4,714,252.

SUMMARY OF THE INVENTION

I have conceived of an improvement in golf putters wherein a generally T-shaped head has a longitudinally-extending bore in the body portion thereof disposed perpendicular to the head of the "T" and in alignment with the intended direction of putting. Within the bore is a series of weighted balls disposed in diametrically abutting relation and held in aligned compression between opposite ends of the bore. The balls are disposed in concentric alignment with the golf ball to be struck by the putter. The striking face of the putter is provided on one side with the aligned series of balls while on the opposite side it contacts the golf ball being putted. Thus, the several weighted balls are swung in the direction of the intended putt; and their kinetic energy is transferred to the golf ball to drive it in the same direction as the alignment of the weighted balls. My tests have indicated that putting is improved when using my putter.

BRIEF DESCRIPTION OF THE DRAWINGS

FIG. I is a top plan view of a putter embodying my invention.

BRIEF DESCRIPTION OF PREFERRED EMBODIMENT

Figure 1:
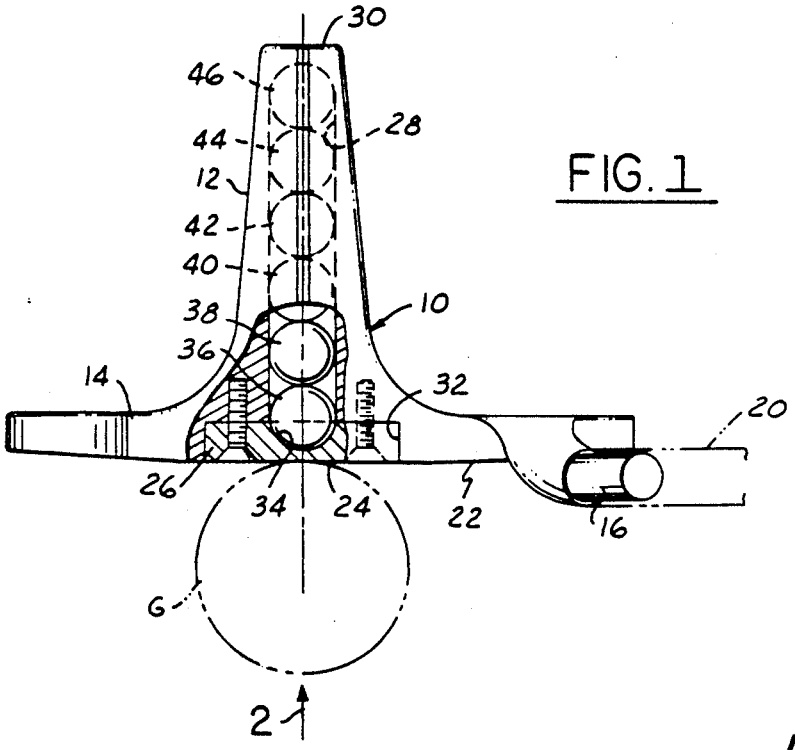

A golf putter embodying my invention comprises a member 10, substantially T-shaped in plan view as best shown in FIG. 1, having a longitudinally-extending body portion 12, and an integral transverse head portion 14 with a shaft 16 connected thereto and extending angularly upwardly therefrom. As will be apparent from FIGS. 1 and 3, the shaft 16 is offset forwardly as at 18 to dispose its centerline 20 slightly ahead of the flat face 22 of the transverse head portion.

Figure 2:
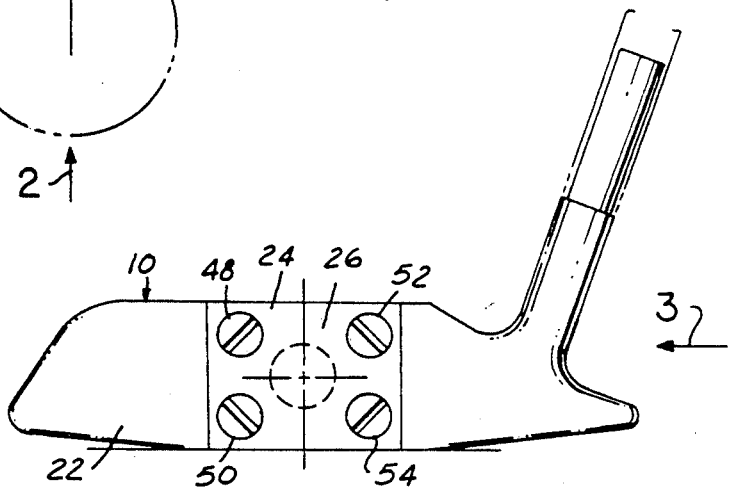
FIG. 2 is a end view looking in the direction of Arrow 2 in FIG. 1.

The flat face 22 of the transverse portion of the head is coincident with a ball-striking surface 24 of the ball-striking plate 26 best shown in FIGS. 1 and 2. Disposed within the longitudinal body portion 12 on one side of the striking plate 24 is a longitudinal bore 28 which extends from adjacent distal end 30 to the ball-striking plate as shown in FIG. 1. The bore 28 extends through the transverse portion 14 and terminates at a generally hemispherical recess 34 disposed in the striking plate 26. The striking plate is received in a chamber 32 let into face 22. The striker plate 26 is relatively thin at the bottom of recess 34 as measured to the striking face 24, i.e., about 1/16"or slightly less. A series of diametrically abutting balls 36, 38, 40, 42, 44, 46 are held under slight compression within the bore by the striking plate 24. The plate is retained in position urging the balls into diametric contact and slight compression by four retaining screws 48, 50, 52, 54, which have flat heads lying coincident with the surface 22 of the transverse head portion and the surface 24 of the striker plate.

In a preferred embodiment the member 10 may be formed of cast aluminum, magnesium, or the like, while the balls 36–46 may be formed of steel, carbide or other dense material. The balls in fact preferably may comprise ½ inch diameter steel ball bearings. The striker plate 26 may be formed of stainless steel or other suitable material.

Figure 3:
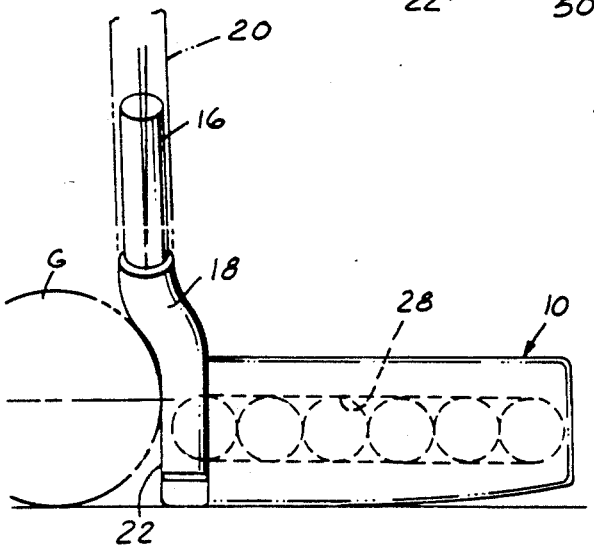
FIG. 3 is a side view looking in the direction of Arrow 3 of FIG. 2.

By making the member 10 of aluminum and the balls 36–46 of steel or a material having a substantially greater mass per unit volume, or density than member 10, and disposing the balls in direct abutment against the striker plate having a relatively thin-wall section between the end ball 36 and a golf ball shown in phantom outline at G in FIGS. 1 and 3, I believe that improved directional control may be imparted to the putt of the ball G when the striker plate face 24 engages the golf ball as the club is swung. I believe the weight or mass of the club head is concentrated in line with the direction of the stroke. Comparing weights per unit volume of steel and aluminum, steel is nearly three times heavier. In one embodiment, the six steel balls weighed 2 oz., while the club head before insertion of the balls weighed 11 oz. It is my belief that these relative weights may be varied by up to ten percent and still retain the effectiveness of the design. The action may be likened to that of a series of suspended steel balls arranged in abutting relation. When the end ball is swung up and then released, it will strike its neighbor and in turn each ball will feel the impact and the ball at the opposite end of the series will jump. It is my belief that the directional stability of the club head and the alignment of its kinetic energy will be directed more accurately using this design for the head than where the head is solid or provided with some other form of arrangement as in the prior art cited above.

What is claimed is:

1. A golf putter comprising, in combination:

a member substantially T-shaped in plan view having a longitudinal body portion and a transverse head portion and having a shaft connected, thereto, and extending angularly upwardly, therefrom;

a generally flat face on the transverse head portion disposed perpendicular to said longitudinal body portion and facing in the direction of an intended putt;

a bore extending longitudinally within the body portion and perpendicular to said face and aligned with the direction of an intended putt; and a plurality of weighted balls arranged longitudinally in diametrically abutting relation and disposed within said bore and formed of a material having a greater density than the density of said member whereby during a putt a transfer of kinetic energy from said weighted balls collectively being swung in the direction of an intended putt to a golf ball substantially aligned with said weighted balls drives the golf ball in the same direction as the alignment of the weighted balls.

2. The invention defined by claim 1 wherein said bore extends into the head portion and terminates adjacent said face.

3. The invention defined by claim 2 wherein said balls are disposed in diametrically abutting relation and in abutting relation with opposite ends of said bore.

4. The invention defined in claim 1 wherein said face includes a ball striking portion in concentric alignment with said bore.

5. The invention defined by claim 1 wherein said bore opens through said flat face and a ball-striking member closes the end of the bore at said flat face.

6. The invention defined by claim 5 wherein means are provided for urging the ball-striking member against the plurality of balls disposed in said bore maintaining them in diametrically abutting relation and in abutting relation with such ball-striking member and the opposite end of said bore.

7. The invention defined by claim 1 wherein said shaft is connected to the transverse head portion and is offset therefrom in the direction of intended putt.

8. The invention defined by claim 1 wherein the balls have a density at least 2.5 times that of said member.

9. The invention defined by claim 1 wherein the balls are formed of steel and said member is aluminum.

* * * * *